US010988882B2

(12) United States Patent
Hoppe et al.

(10) Patent No.: US 10,988,882 B2
(45) Date of Patent: Apr. 27, 2021

(54) LAUNDRY TREATMENT APPLIANCE SLIDER-BASED USER INTERFACE

(71) Applicant: Midea Group Co., Ltd., Foshan (CM)

(72) Inventors: Christopher G. Hoppe, Louisville, KY (US); Bryan T. Snook, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 220 days.

(21) Appl. No.: 16/020,493

(22) Filed: Jun. 27, 2018

(65) Prior Publication Data

US 2020/0002866 A1 Jan. 2, 2020

(51) Int. Cl.
*D06F 33/00* (2020.01)

(52) U.S. Cl.
CPC ..... *D06F 33/00* (2013.01); *D06F 2210/00* (2013.01); *D06F 2212/02* (2013.01); *D06F 2214/00* (2013.01)

(58) Field of Classification Search
CPC ..... D06F 34/28; D06F 34/30; D06F 34/32; D06F 33/00; D06F 33/36; D06F 2101/00
See application file for complete search history.

(56) References Cited

U.S. PATENT DOCUMENTS 3,727,014 A * 4/1973 Apel ..... D06F 58/30 200/33 R
6,169,964 B1 * 1/2001 Aisa ..... D06F 34/28 702/136
6,215,490 B1 4/2001 Kaply
6,775,924 B2 8/2004 Bruntz et al.
7,516,629 B2 4/2009 Behrens et al.
7,735,020 B2 6/2010 Chaudhri
9,552,146 B2 1/2017 Schneider
9,671,944 B2 6/2017 Hanumara et al.
2002/0017117 A1 2/2002 Sunshine et al.
2004/0211083 A1 * 10/2004 Park ..... D06F 58/30 34/528
2005/0091604 A1 4/2005 Davis
2006/0010611 A1 1/2006 Snow
2011/0099731 A1 * 5/2011 Im ..... D06F 37/306 8/137
2013/0113837 A1 5/2013 Kamihara et al.
2014/0109322 A1 * 4/2014 Park ..... D06F 58/206 8/137
2014/0234496 A1 * 8/2014 Siegel ..... F23N 5/242 426/231
2015/0345068 A1 12/2015 Coffman et al.
2017/0175317 A1 * 6/2017 Kim ..... D06F 34/28

OTHER PUBLICATIONS

O'Boyle. "Samsung WW9000 Smart Washing Machine Offers Full LCD Touchscreen, Smartphone-Like Controls" www.pocket-lint.com. Apr. 23, 2014.

* cited by examiner

*Primary Examiner* — Spencer E Bell
(74) *Attorney, Agent, or Firm* — Middleton Reutlinger

(57) ABSTRACT

A laundry treatment appliance, program product and method utilize a slider-based user interface to facilitate user selection of settings for a laundry treatment cycle. A slider-based user interface, for example, may include a fabric slider control that receives user input that selects from among a plurality of fabric selections and a cycle modifier slider control that receives user input that selects from among a plurality of cycle modifier selections capable of increasing and/or decreasing various default settings associated with various fabric selections.

27 Claims, 5 Drawing Sheets

LAUNDRY TREATMENT APPLIANCE SLIDER-BASED USER INTERFACE

BACKGROUND

Laundry treatment appliances such as laundry washing machines and dryers are used in many single-family and multi-family residential applications to clean and dry clothes and other fabric items. Due to the wide variety of items that may need to be cleaned by a laundry washing machine, for example, many laundry washing machines provide a wide variety of user-configurable settings to control various aspects of a wash cycle such as water temperatures and/or amounts, agitation, soaking, rinsing, spinning, etc. The cycle settings can have an appreciable effect on washing performance, as well as on energy and/or water consumption, so it is generally desirable for the settings used by a laundry washing machine to appropriately match the needs of each load washed by the machine.

Some laundry washing machines also support user selection of load types, typically based on the types of fabrics and/or items in the load. Some laundry washing machines, for example, have load type settings such as colors, whites, delicates, cottons, permanent press, towels, bedding, heavily soiled items, etc. These manually-selectable load types generally represent specific combinations of settings that are optimized for particular load types so that a user is not required to select individual values for each of the controllable settings of a laundry washing machine. These selections are also in many instances mixed with other selections associated with specific loads, soil scale, spin speed, temperature, etc., and in some instances, an estimated cycle time may also be presented to a user while the user is making selections. The number of choices that a user may be presented with may therefore be considerable and may lead to user confusion.

Laundry dryers may similarly include a wide variety of user settings that can have an appreciable effect on drying performance and/or energy consumption. Many laundry dryers also support user selection of load types.

While manual load type selection in many cases simplifies a user's interaction with a laundry treatment appliance, such manual selection still can lead to suboptimal performance due to, for example, user inattentiveness or lack of understanding of which load types are best suited for their particular loads. Therefore, a significant need continues to exist in the art for a manner of optimizing the performance of a laundry treatment appliance for different types of loads, as well as reducing the burden on users when interacting with a laundry treatment appliance.

SUMMARY

The herein-described embodiments address these and other problems associated with the art by providing a laundry treatment appliance, program product and method that utilize a slider-based user interface to facilitate user selection of settings for a laundry treatment cycle. A slider-based user interface, for example, may include a fabric slider control that receives user input that selects from among a plurality of fabric selections and a cycle modifier slider control that receives user input that selects from among a plurality of cycle modifier selections capable of increasing and/or decreasing various default settings associated with various fabric selections.

Therefore, consistent with one aspect of the invention, a laundry treatment appliance includes a container rotatably disposed within a housing, a drive system configured to rotate the container, a controller coupled to the drive system and configured to perform a laundry treatment cycle on a load disposed in the container, and a processor in communication with a user interface through which user input is received to configure a plurality of settings for the laundry treatment cycle performed by the controller. The user interface includes a fabric slider control configured to receive user input that selects from among a plurality of fabric selections, and a cycle modifier slider control configured to receive user input that selects from among a plurality of cycle modifier selections, the plurality of cycle modifier selections including one or more cycle increase selections and one or more cycle decrease selections. The processor is configured to, in response to selection of a first fabric selection from among the plurality of fabric selections and a first cycle modifier selection from among the plurality of cycle modifier selections, select a combination of setting values for the plurality of settings for use in performing the laundry treatment cycle.

In some embodiments, each of the plurality of fabric selections is associated with a default combination of setting values for the plurality of settings that is optimized for treating an associated fabric. In addition, in some embodiments, each of the one or more cycle increase selections and each of the one or more cycle decrease selections is associated with, for each of the plurality of fabric selections, a modified combination of setting values that differs from the default combination of setting values.

In some embodiments, the plurality of cycle modifier selections further includes a default selection, and the processor is configured to, when the first cycle modifier selection is the default selection, use the default combination of setting values for the first fabric selection as the selected combination of setting values to use when performing the laundry treatment cycle. Further, in some embodiments, the processor is configured to, when the first cycle modifier selection is one of the one or more cycle increase selections, use a modified combination of setting values as the selected combination of setting values to use when performing the laundry treatment cycle, and the modified combination of setting values includes at least one setting value that is increased relative to a corresponding setting value in the default combination of setting values for the first fabric selection. Moreover, in some embodiments, the modified combination of setting values includes a plurality of setting values that are increased relative to corresponding setting values in the default combination of setting values for the first fabric selection.

In addition, in some embodiments, the processor is configured to, when the first cycle modifier selection is one of the one or more cycle decrease selections, use a modified combination of setting values as the selected combination of setting values to use when performing the laundry treatment cycle, and the modified combination of setting values includes at least one setting value that is decreased relative to a corresponding setting value in the default combination of setting values for the first fabric selection. In some embodiments, the modified combination of setting values includes a plurality of setting values that are decreased relative to corresponding setting values in the default combination of setting values for the first fabric selection.

In some embodiments, each of the one or more cycle increase selections and each of the one or more cycle decrease selections is associated with a modifier value that, when the associated cycle increase selection or cycle decrease selection is the first cycle modifier selection, scales one or more setting values in the default combination of setting values for the first fabric selection. In addition, in some embodiments, the one or more cycle increase selections are each identified in the user interface by a positive percentage value, and each of the one or more cycle increase selections are each identified in the user interface by a negative percentage value.

In some embodiments, the processor is configured to select the combination of setting values for the plurality of settings for use in performing the laundry treatment cycle by accessing a table of setting combinations indexed by fabric selection and cycle modifier selection. Further, in some embodiments, the laundry treatment appliance is a washing machine, and the plurality of settings include an agitation setting, a water level setting, a wash time setting, a rinse time setting, a spin time setting, a wash repeat setting, a rinse repeat setting, a spin repeat setting, a spin speed setting, a steam setting, a sanitize setting, a temperature setting, and/or a soak time setting. In other embodiments, the laundry treatment appliance is a dryer, and the plurality of settings include a cycle time setting, a temperature setting, a steam setting, and/or a speed setting. Further, in some embodiments, the processor is disposed in the controller, the user interface is disposed on the housing, and the processor further performs the laundry treatment cycle on the load disposed in the container. Moreover, in some embodiments, the processor is disposed in an external device in communication with the controller, the user interface is disposed on the external device, and the processor is further configured to communicate the selected combination of setting values to the controller.

In some embodiments, the external device is a mobile phone or tablet, and in some embodiments, the user interface comprises a touchscreen display. In some embodiments, each of the fabric slider control and the cycle modifier slider control includes a touch-sensitive strip, while in some embodiments, each of the fabric slider control and the cycle modifier slider control includes a mechanical slider. In some embodiments, the mechanical slider for each of the fabric slider control and the cycle modifier slider control is motorized. In some embodiments, each of the fabric slider control and the cycle modifier slider control includes up and down buttons, and in some embodiments, each of the fabric slider control and the cycle modifier slider control is a rotary control.

In some additional embodiments, the user interface further includes a plurality of optional feature buttons, and the processor is further configured to, in response to activate an optional feature during the laundry treatment cycle in response to selection of an associated optional feature button from among the plurality of optional feature buttons. In some embodiments, the user interface further includes a preset slider control configured to receive user input that selects from among a plurality of preset selections, each of the plurality of preset selections includes an associated fabric selection from among the plurality of fabric selections and an associated cycle modifier selection from among the plurality of cycle modifier selections, and the processor is configured to, in response to selection of a first preset selection from among the plurality of preset selections, select the associated fabric selection for the first preset selection on the fabric slider control and select the associated cycle modifier selection for the first present selection on the cycle modifier slider control.

Further, in some embodiments, the processor is further configured to, in connection with performing the laundry treatment cycle, update the first preset selection based upon current selections of each of the fabric slider control and cycle modifier slider control. In some embodiments, the user interface further includes a spin speed slider control configured to receive user input that selects from among a plurality of spin speed selections and a temperature slider control configured to receive user input that selects from among a plurality of temperature selections, and the processor is configured to set spin speed and temperature settings for use in performing the laundry treatment cycle based upon user input directed to the spin speed slider control and temperature slider control. In addition, in some embodiments, the processor is configured to pause the laundry treatment cycle in response to user input directed to the user interface, to modify the selected combination of setting values for the plurality of settings in response to user input directed to the fabric slider control and/or the cycle modifier slider control while the laundry treatment cycle is paused, and to restart the laundry treatment cycle using the modified combination of setting values in response to user input directed to the user interface.

Consistent with another aspect of the invention, a program product includes a non-transitory computer readable medium and program code stored on the computer readable medium and configured upon execution by one or more processors to configure a plurality of settings for a laundry treatment cycle performed by a laundry treatment appliance of a type including a container rotatably disposed within a housing, a drive system configured to rotate the container, and a controller configured to perform the laundry treatment cycle on a load disposed in the container. The program code may be configured to receive user input from a user interface including a fabric slider control configured to receive user input that selects from among a plurality of fabric selections and a cycle modifier slider control configured to receive user input that selects from among a plurality of cycle modifier selections, the plurality of cycle modifier selections including one or more cycle increase selections and one or more cycle decrease selections. The program code may further be configured to, in response to selection of a first fabric selection from among the plurality of fabric selections and a first cycle modifier selection from among the plurality of cycle modifier selections, select a combination of setting values for the plurality of settings for use in performing the laundry treatment cycle.

Consistent with yet another aspect of the invention, a method may be provided for configuring a plurality of settings for a laundry treatment cycle performed by a laundry treatment appliance of a type including a container rotatably disposed within a housing and a drive system configured to rotate the container. The method may include receiving user input to configure a plurality of settings for the laundry treatment cycle from a user interface including a fabric slider control configured to receive user input that selects from among a plurality of fabric selections, and a cycle modifier slider control configured to receive user input that selects from among a plurality of cycle modifier selections, the plurality of cycle modifier selections including one or more cycle increase selections and one or more cycle decrease selections, in response to selection of a first fabric selection from among the plurality of fabric selections and a first cycle modifier selection from among the plurality of cycle modifier selections, selecting a combination of setting values for the plurality of settings, and performing the laundry treatment cycle using the selected combination of setting values.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
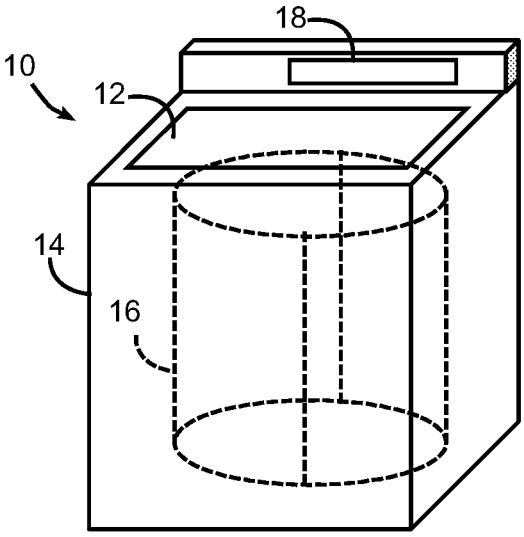
FIG. 1 is a perspective view of a top-load laundry washing machine consistent with some embodiments of the invention.

Embodiments consistent with the invention may be used to configure a plurality of settings of a laundry treatment cycle based upon user input received through a slider-based user interface. As will become more apparent below, a slider-based user interface may be implemented on a laundry treatment appliance or on an external device in communication therewith, and may incorporate at least a fabric slider control that selects from among a plurality of fabric selections and a cycle modifier slider control that selects from among a plurality of cycle modifier selections. In some embodiments each fabric selection is associated with a default combination of setting values optimized for a particular fabric, and the cycle modifier selections may be used to modify these default setting values. For example, the cycle modifier selections may include cycle increase selections that increase one or more default setting values for a selected fabric, e.g., to increase one or more of a time of a phase during the laundry treatment cycle, a water fill level, a temperature, a number of phase repeats, a duty cleaning, etc. Likewise, the cycle modifier selections may also include cycle decrease selections that decrease one or more of such default setting values for a selected fabric.

The combination of a cycle modifier control and a fabric control may be considered in some embodiments to support a plurality of different cycle setting configurations for a given fabric. Thus, for example, currently there are a variety of cotton-based fabrics that have varying sensitivities to temperature, aggressiveness of mechanical action, water level, wrinkling, absorption, shrinkage, etc. Through the use of a cycle modifier control as described herein, a user may effectively select from among multiple types (or sub-types) of cotton cycles, e.g., based upon the user's prior experiences or based on a textile label.

A laundry treatment appliance, in this regard, may be considered to include any number of different types of appliances capable of treating laundry, including, for example, laundry washing machines, laundry dryers, combined washer/dryers, etc., and for which various settings may be used to configure how a laundry treatment cycle is implemented on the appliance. A setting, in this regard, may include any number of different configurable aspects of a laundry treatment cycle performed by a laundry treatment appliance including, but not limited to, a wash water temperature, a rinse water temperature, a wash water amount, a rinse water amount, a speed or stroke of agitation during washing and/or rinsing, a spin speed, whether or not agitation is used during washing and/or rinsing, whether or not spinning is performed, a duration of a wash, rinse, soak, or spin phase of a wash cycle, a number of repeats of a wash, rinse, soak or spin phase, selection between different rinse operation types such as a spray rinse operation or a deep fill rinse operation, pre-treatment such as soaking over time with a prescribed water temperature and specific agitation stroke, a steam feature, a sanitize feature, a drying temperature, a drying time, a dryness setting, etc.

Numerous additional variations and modifications will be apparent to one of ordinary skill in the art, as will become apparent from the description below. Therefore, the invention is not limited to the specific implementations discussed herein.

Turning now to the drawings, wherein like numbers denote like parts throughout the several views, FIG. 1 illustrates an example laundry treatment appliance, here a laundry washing machine 10, in which the various technologies and techniques described herein may be implemented. Laundry washing machine 10 is a residential-type top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
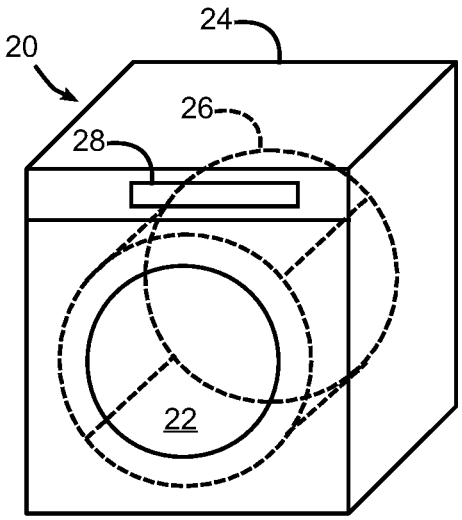
FIG. 2 is a perspective view of a front-load laundry washing machine consistent with some embodiments of the invention.

As noted above, laundry washing machine 10 is an example of a residential-type top-load laundry washing machine, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry treatment appliance configurations, including laundry dryers, combined washer/dryers and other laundry washing machine designs. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques selection within a front-load laundry washing machine would be well within the abilities of one of ordinary skill in the art having the benefit of the instant disclosure, so the invention is not limited to the top-load implementation discussed further herein. It will also be appreciated that FIGS. 1 and 2 are also representative of top-load and front-load laundry dryers, but where the wash tubs 16, 26 are replaced with drums, as will be appreciated by those skilled in the art.

Figure 3:
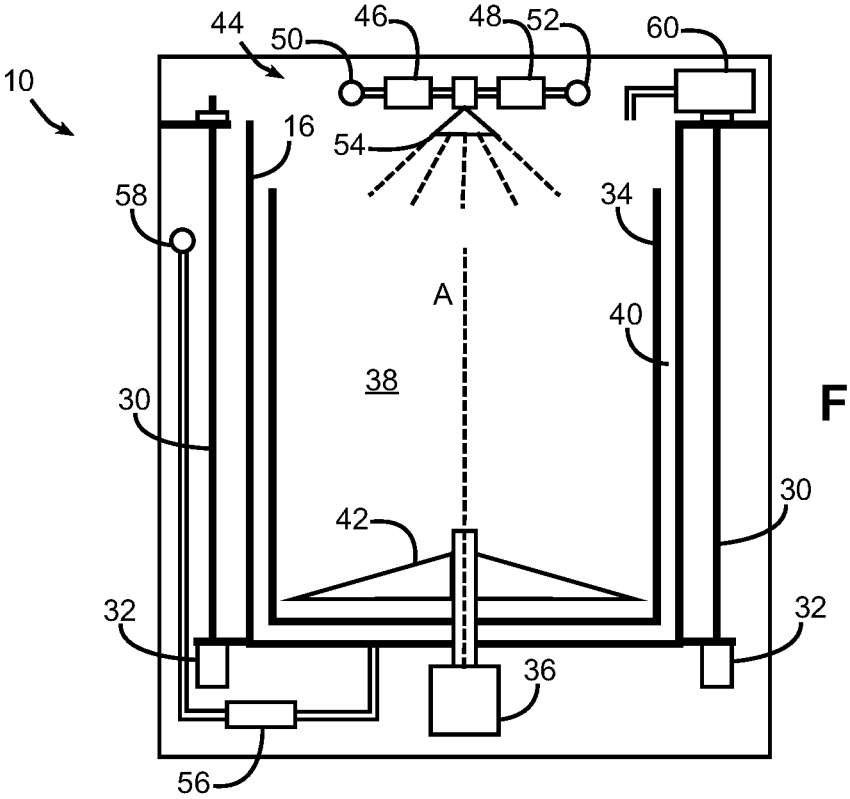
FIG. 3 is a functional vertical section of the laundry washing machine of FIG. 1.

FIG. 3 functionally illustrates a number of components in laundry washing machine 10 as is typical of many washing machine designs. For example, wash tub 16 may be vertically oriented, generally cylindrical in shape, opened to the top and capable of retaining water and/or wash liquor dispensed into the washing machine. Wash tub 16 may be supported by a suspension system such as a set of support rods 30 with corresponding vibration damper cylinders 32.

Disposed within wash tub 16 is a container or wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used. It will be appreciated that where the laundry treatment appliance is a dryer, the container may be a drum.

In addition, in some embodiments an agitator 42 such as an impeller, auger or other agitation element may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump system 56, e.g., including a pump and an electric motor, may be coupled between a low point, bottom or sump in wash tub 16 and an outlet 58 to discharge greywater from wash tub 16. In some embodiments, laundry washing machine 10 may also include a dispensing system 60 configured to dispense detergent, fabric softener and/or other wash-related products into wash tub 16, either from a bulk supply storing sufficient products for dispensing to multiple loads or from a single-use supply filled by a user prior to the start of a wash cycle.

Further, laundry washing machine 10 may also include various sensors for use in at least partially automating a wash cycle, e.g., one or more of a weight sensor, a fluid level sensor, a fluid property sensor, a temperature sensor, a flow sensor, an electronically controlled drive motor, load cell sensor, etc. A weight sensor may be used to generate a signal that varies based in part on the mass or weight of the contents of wash tub 16. A fluid level sensor may be used to generate a signal that varies with the level or height of fluid in wash tub 16. A fluid property sensor, e.g., a turbidity/conductivity sensor, may be used in some embodiments to measure one or more of the turbidity, clarity, conductivity or temperature of the fluid in wash tub 16, e.g., to sense the presence or relative amount of various wash-related products such as detergents or fabric softeners and/or to sense the presence or relative amount of soil in the fluid. A temperature sensor may be used to sense the temperature of fluid in wash tub 16 and/or fluid introduced through hot and/or cold inlets 50, 52. A flow sensor, e.g., one or more flowmeters, may be used to sense an amount of water dispensed into wash tub 16. Representative locations of these various types of sensors are not illustrated in FIG. 3 for reasons of simplifying the discussion; however, the various locations and configurations of such sensors will be apparent to those of ordinary skill having the benefit of the instant disclosure. It will be also be appreciated that some or all of these sensors may be omitted in some embodiments.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3. Moreover, for a combined washer/dryer or laundry dryer, it will be appreciated that the components and configuration of such designs may vary considerably from that illustrated in FIG. 3, e.g., where the rotatable container is a drum, and no separate wash tub is used in the appliance.

Figure 4:
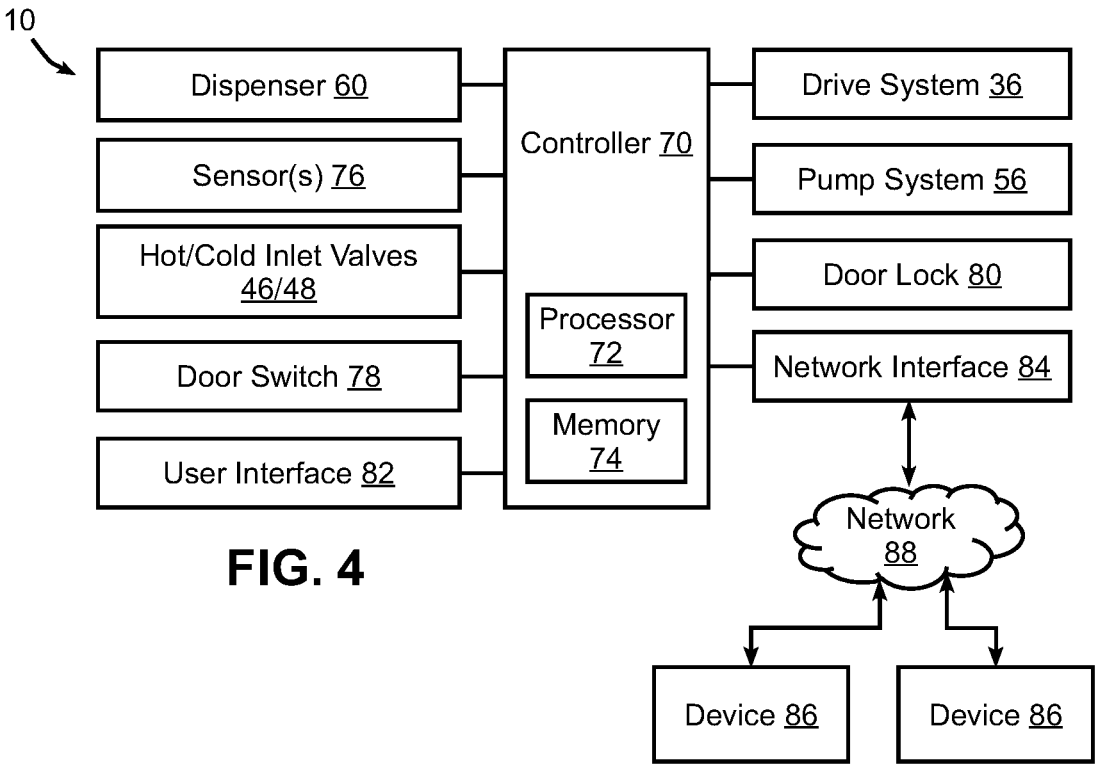
FIG. 4 is a block diagram of an example control system for the laundry washing machine of FIG. 1.

Now turning to FIG. 4, laundry washing machine 10 may be under the control of a controller 70 that receives inputs from a number of components and drives a number of components in response thereto. Controller 70 may, for example, include one or more processors 72 and a memory 74 within which may be stored program code for execution by the one or more processors. The memory may be embedded in controller 70, but may also be considered to include volatile and/or non-volatile memories, cache memories, flash memories, programmable read-only memories, read-only memories, etc., as well as memory storage physically located elsewhere from controller 70, e.g., in a mass storage device or on a remote computer interfaced with controller 70.

As shown in FIG. 4, controller 70 may be interfaced with various components, including the aforementioned drive system 36, hot/cold inlet valves 46, 48, pump system 56, sensors (e.g., weight, fluid property, flow, acceleration, temperature, etc., collectively represented at 76), a door switch 78 that detects whether door 12 is in an open or closed position and a door lock 80 that selectively locks door 12 in a closed position. Where controller 70 is interfaced with a laundry dryer or other type of laundry treatment appliance, the components to which controller is interfaced may vary considerably.

Moreover, controller 70 may be coupled to a user interface 82 including various input/output devices such as knobs, dials, sliders, switches, buttons, lights, textual and/or graphics displays, touch screen displays, speakers, image capture devices, microphones, etc. for receiving input from and communicating with a user. In addition, in some embodiments, controller 70 may also be coupled to one or more network interfaces 84, e.g., for interfacing with external devices 86 via wired and/or wireless networks such as Ethernet, Wi-Fi, Bluetooth, NFC, cellular and other suitable networks, collectively represented by network 88 in FIG. 4. Network 86 may incorporate in some embodiments a home automation network, and various communication protocols may be supported, including various types of home automation communication protocols. In other embodiments, other wireless protocols, e.g., Wi-Fi or Bluetooth, may be used.

Devices 86 may include, for example, various user devices such as computers, tablets, smart phones, wearable devices, etc., as well as various online services and devices, e.g., web or cloud services. Moreover, in some embodiments, at least a portion of controller 70 may be implemented externally from a laundry washing machine, e.g., within a mobile device, a cloud computing environment, etc., such that at least a portion of the functionality described herein is implemented within the portion of the controller that is externally implemented. Further, in some embodiments, at least a portion of user interface 82 may be implemented on a device 86, e.g., where a mobile device or tablet is used to configure setting values for a laundry treatment appliance and communicate those setting values to controller 70 for use during a laundry treatment cycle.

In some embodiments, controller 70 may operate under the control of an operating system and may execute or otherwise rely upon various computer software applications, components, programs, objects, modules, data structures, etc. In addition, controller 70 may also incorporate hardware logic to implement some or all of the functionality disclosed herein. Further, in some embodiments, the sequences of operations performed by controller 70 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the laundry treatment appliances illustrated in FIGS. 1-4 will be apparent to one of ordinary skill in the art, as will become apparent from the description below. Therefore, the invention is not limited to the specific implementations discussed herein.

Slider-Based User Interface for Laundry Treatment Appliance

Due to the myriad types of settings provided to users in various conventional laundry treatment appliance designs, it can be difficult for a user to select the optimal combination of setting values for treating a particular load of laundry. Embodiments consistent with the invention address these and other problems through the use of a slider-based user interface based in part upon a plurality of slider controls that may be used to set a combination of setting values for a plurality of settings used to control a laundry treatment cycle in a laundry treatment appliance.

Each slider control may be considered to define a plurality of user-selectable selections defined across a range of positions for the slider control. In some embodiments, a slider control may be discrete, and have discrete positions for particular selections. Alternatively, in some embodiments, a slider control may be continuous, and selections may be associated with particular positions or subranges of positions within the range of positions for the slider control. As will become more apparent below, a slider control may be implemented in a number of manners, including using various combinations of physical and/or virtual controls such as sliders, buttons, joysticks, knobs, touch-sensitive surfaces, displays, touchscreens, etc. A slider control may have detents or stops to delineate discrete positions in some embodiments, and in some embodiments, labels delineating various selections may be integrated into the slider control itself (e.g., displayed on a graphical display), or may be positioned adjacent to a slider control (e.g., on a physical control panel adjacent to the slider control). Moreover, while the herein-described slider controls are linear controls, whereby the range of positions for the slider controls extend along a linear axis, the invention is not so limited, and as such, a slider controls in other embodiments may incorporate positional axes that are curved, may include positions extending in two or more dimensions, or may incorporate rotary positions (e.g., using rotary controls such as knobs). Further, in some embodiments, multiple slider controls may be integrated into a common control, e.g., where the positions of one slider control extend along a linear axis that is orthogonal to and intersect the linear axis along which the positions of another slider control extend (e.g., using a two-dimensional joystick). Moreover, where slider controls are implemented virtually (e.g., displayed on a graphical display), an innumerable number of variations may be supported. Other variations will be apparent to those of ordinary skill having the benefit of the instant disclosure.

In some embodiments, a pair of slider controls, referred to as a fabric slider control and a cycle modifier slider control, may be predominantly used to set a combination of setting values for a plurality of settings used to control a laundry treatment cycle in a laundry treatment appliance. The fabric slider control may be used, for example, to select from among a plurality of fabric types in a load to be treated. The various fabric types supported by a fabric slider control may include, but are not limited to cotton, various synthetics (e.g., polyester, nylon, spandex, acrylic, acetate, etc.), silk, wool, linen, hemp, rayon, etc. In some instances, similar fabric types may be combined into one selection, e.g., linen and hemp, or various synthetic fabrics (e.g., combined under a label such as "synthetic" or "poly").

In the illustrated embodiments, each fabric selection may define a default combination of setting values that are optimized for its associated fabric type. The combination of setting values, for example, may define values for various types of settings such as the times of various phases in a cycle, whether certain phases are repeated, and if so, how many times, an air or water temperature to use in a treatment cycle, whether certain optional features are enabled, etc. The default combinations of setting values may be determined empirically in some embodiments, e.g., by a manufacturer, or in other appropriate manners.

The cycle modifier slider control may be used, for example, to select from among a plurality of cycle modifier selections, where at least some of the cycle modifier selections are cycle increase selections and cycle decrease selections. The cycle modifier selections may be used to effectively modify the aforementioned default combinations of setting values for different fabrics, either increasing or decreasing one or more of the setting values relative to the corresponding setting values in the default combination of setting values for one or more of the fabrics such that the combination of setting values used for the laundry treatment cycle differs from the default combination. In some embodiments, the cycle modifier slider control may also include a default selection that causes the default combination of setting values for the selected fabric selection to be used to control the laundry treatment cycle.

In some instances, the cycle modifier selections may be associated with modifier values that are used to scale one or more setting values, e.g., based upon a percentage, and in some instances these modifier values may be represented by percentage values in the user interface. In some instances, the percentage values may be numerically identical to their associated cycle modifiers (e.g., a +10% percentage value conforms to a cycle modifier that increases one or more setting values by 10%), while in other instances, the percentage values may be used to represent relative positions within a range of modifier values (e.g., where a +20% percentage value refers to a cycle modification that is roughly twice as significant as a +10% percentage value) or the percentage values may not have any direct relationship to any particular modifier value (e.g., a +10% percentage value conforms to a cycle modifier that increases one or more setting values by a fixed amount, or a percentage amount that differs from 10%).

Moreover, while some cycle modifier selections are referred to as scaling various setting values, it will be appreciated that mathematical calculations to perform such scaling may or may not be performed when calculating setting values in different embodiments. For example, in some embodiments, a table (which may be represented using various types of data structures) may be used to store combinations of setting values indexed by both fabric selection and cycle modifier selection. Thus, rather than performing mathematical calculations to scale or modify setting values from the default combination of setting values associated with a currently selected fabric selection, the current fabric and cycle modifier selections may be used to access a table entry corresponding to those selections in order to retrieve the appropriate combination of setting values to use for the laundry treatment cycle. In addition, cycle modifier selections may also be used to modify settings associated with one or more optional features (e.g., to vary a time of a steam phase when a steam feature is enabled).

Figure 5:
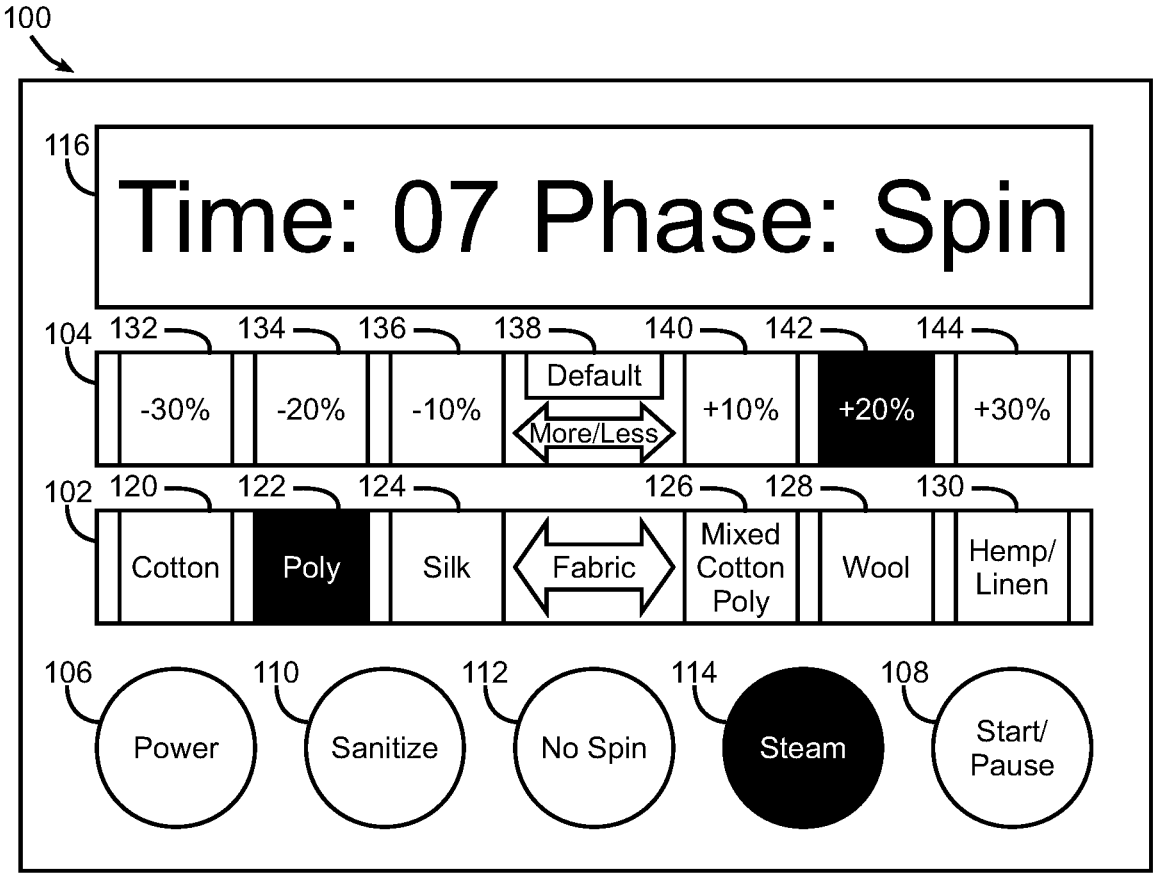
FIG. 5 illustrates an example implementation of a slider-based user interface suitable for use in the laundry washing machines of FIGS. 1-4.

FIG. 5, for example, illustrates an example user interface 100 incorporating a fabric slider control 102 and a cycle modifier slider control 104 consistent with some embodiments of the invention. User interface 100 in this embodiment may be implemented as a physical control panel on a cabinet or housing of a laundry washing machine and controlled by the on-board controller that performs the laundry treatment cycle, and may also include various additional physical button controls, e.g., including a power button 106, a start/pause button 108, and a number of optional feature buttons, e.g., a sanitize button 110, a no spin button 112 and a steam button 114, each of which, when activated, causes the associated feature to be active during a laundry treatment cycle. In addition, a display 116, e.g., a segmented or dot matrix LCD, LED, VFD or other display, may be incorporated into the user interface to provide user feedback to a user along with current status information (e.g., the progress of an active laundry treatment cycle, with FIG. 5 illustrating by way of example a current status where there are 7 minutes remaining in cycle, and where the cycle is currently in the spin phase).

In this embodiment, slider controls 102, 104 are each implemented using a touch-sensitive strip defining a plurality of touch-sensitive buttons 120-144 along a linear axis of the respective slider control, which are further capable of being illuminated (e.g., via backlit LEDs) when active. Fabric slider control 102, for example, may be labeled with a "Fabric" arrow label, and may include a cotton button 120, poly button 122, silk button 124, mixed cotton poly button 126, wool button 128 and hemp/linen button 130 to define respective fabric selections. Likewise, cycle modifier slider control 104 may be labeled with a "More/Less" arrow label, and may include three decrease buttons 132, 134, 136, a default button 138, and three increase buttons 140, 142, 144 to define respective −30%, −20%, −10%, default, +10%, +20% and +30% cycle modifier selections. User selection of a button 120-144 may select that button and deselect any other buttons in the same slider control, and as such, FIG. 5 illustrates user interface 100 with a synthetic fabric selection via selection of button 122, a +20% cycle modifier selection via selection of button 142, and activation of a steam optional feature via selection of button 114.

Figure 6:
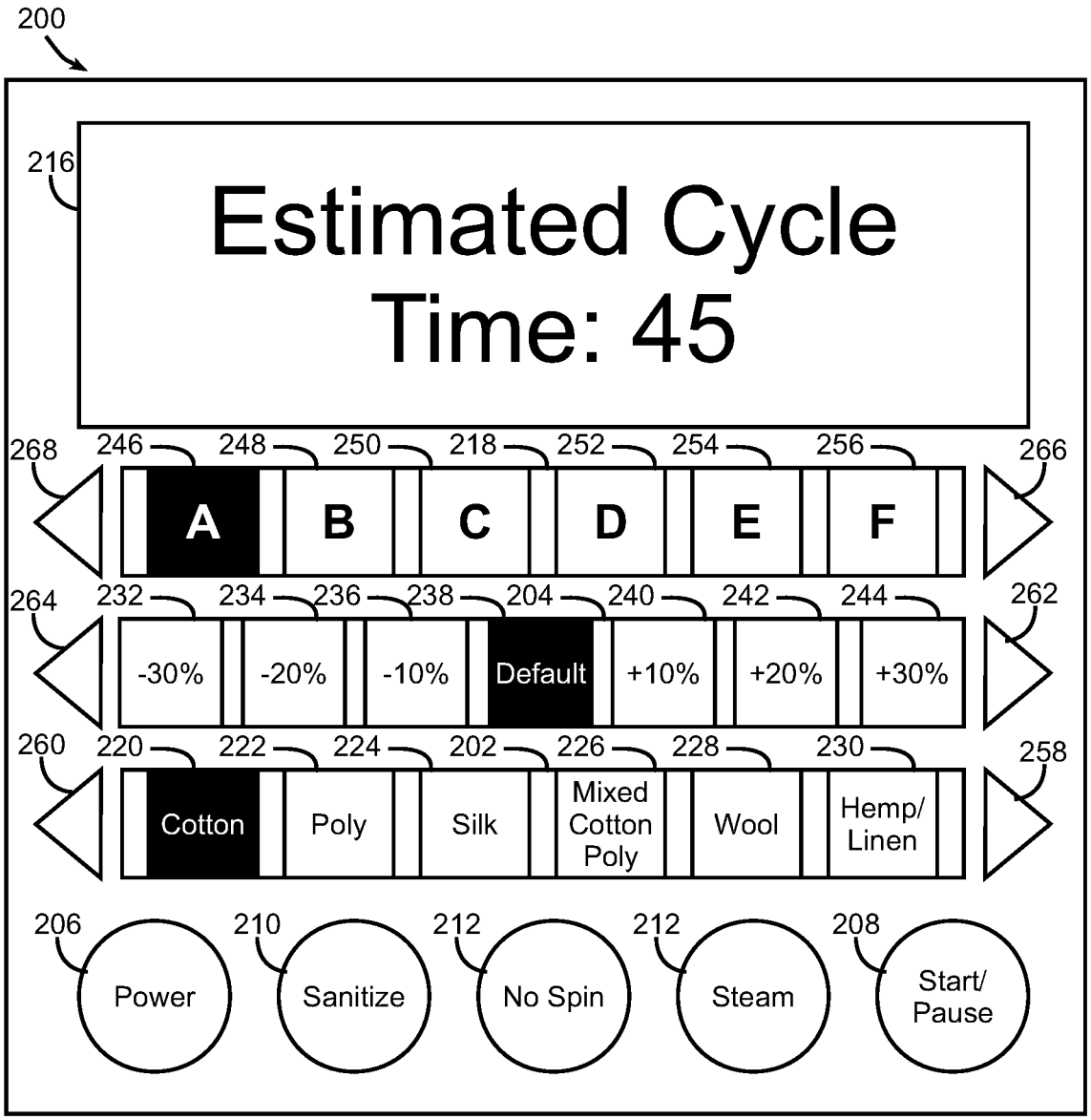
FIG. 6 illustrates another example implementation of a slider-based user interface suitable for use in the laundry washing machines of FIGS. 1-4.

FIG. 6 illustrates an alternate user interface 200, which similar to user interface 100, includes a fabric slider control 202, a cycle modifier slider control 204, a plurality of buttons 206-214 and a display 216, and which also may be suitable for implementation on the housing or cabinet of a laundry treatment appliance. As is also illustrated by this figure, it may also be desirable in some embodiments to display one or more setting values associated with the current user interface control inputs to enable a user to see in real time how modifications to one or more controls will affect the laundry treatment cycle. In may be desirable, for example, and as illustrated by display 216, to provide a user with a predicted total cycle time to enable a user to determine how changing different controls affects the overall duration of a laundry treatment cycle.

In addition, user interface 200 includes an additional slider control 218, referred to herein as a preset slider control, which is used to select from among a plurality of preset settings. Each preset setting is associated with an associated fabric selection and an associated cycle modifier selection such that, whenever a preset setting is selected by a user, the associated fabric and cycle modifier selections are automatically selected. In some embodiments, these preset settings may be configurable by a user, thereby enabling a user to store various favorite combinations of setting values for reuse in the future. As will become more apparent below, in some embodiments any modifications made to a preset setting prior to running a laundry treatment cycle may be used to update the preset setting in connection with running the laundry treatment cycle (e.g., prior to, during or after completion of the laundry treatment cycle).

Further, while user interface 100 included touch-sensitive strips for the slider controls, user interface 200 implements slider controls 202, 204 and 218 using up and down buttons (e.g., up and down buttons 258, 260 for slider control 202, up and down buttons 262, 264 for slider control 204 and up and down buttons 266, 268 for slider control 218). Rather than buttons corresponding to selections, however, slider controls 202, 204 and 218 include indicators 220-256 to represent the various selections in the respective slider controls. The indicators 220-256 may be illuminated or otherwise highlighted to indicate when an associated selection is selected, and as such, through the manipulation of buttons 258-268, a user may sequentially activate different selections along the linear axis of the associated slide control. Thus, for example, with the cotton fabric selection selected as represented by the illumination of indicator 220 in FIG. 6, a user wishing to select a wool selection represented by indicator 228 would press up button 258 four times, with each of indicators 222, 224, 226 and 228 illuminated after each button depression.

Figure 7:
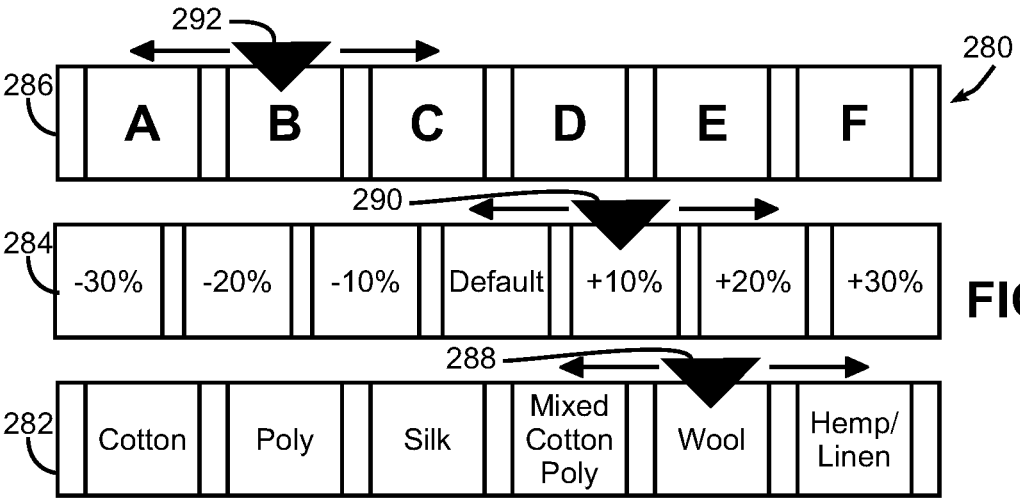
FIG. 7 illustrates yet another example implementation of a slider-based user interface suitable for use in the laundry washing machines of FIGS. 1-4.

FIG. 7 illustrates yet another example user interface 280 including example fabric, cycle modifier and preset slider controls 282, 284, 286 implemented as mechanical sliders, e.g., sliders 288, 290 and 292, and which also may be suitable for implementation on the housing or cabinet of a laundry treatment appliance. Each slider control 282, 284, 286 may also include labels corresponding to each fabric, cycle modifier and preset selection as illustrated in FIG. 7, and these labels may be printed on an opaque surface in some embodiments, or may be illuminated in other embodiments. In some embodiments, the sliders 288, 290 and 292 may be movable solely in response to user effort, while in other embodiments the sliders may be motorized, e.g., to reduce user effort, or alternatively, to automatically reposition sliders in appropriate circumstances. For example, it may be desirable in some embodiments to automatically move sliders 288 and 290 to select the appropriate fabric and cycle modifier selections in response to a user sliding slider 292 to a particular preset selection.

Figure 8:
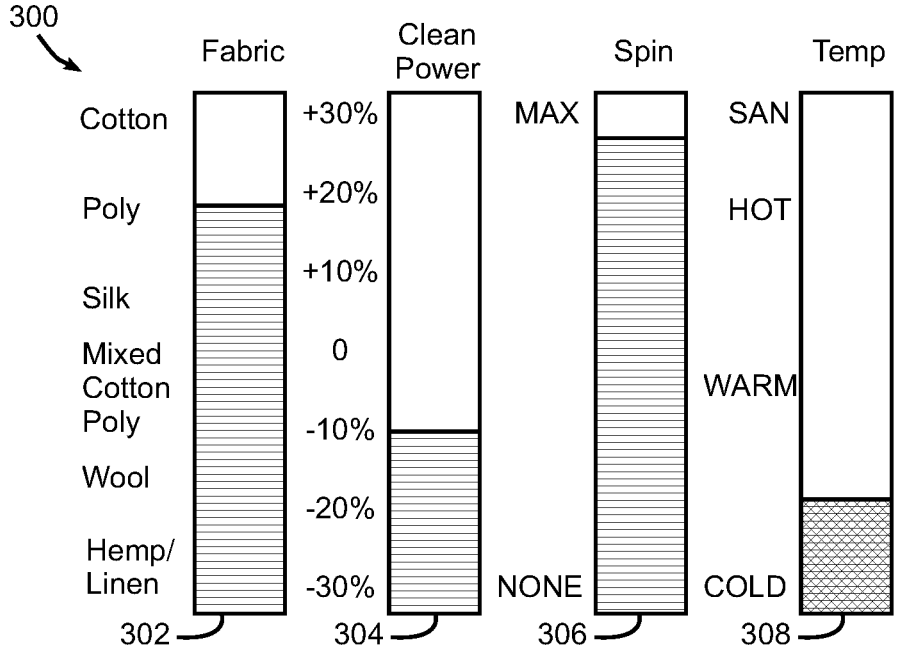
FIG. 8 illustrates a further example implementation of a slider-based user interface suitable for use in the laundry washing machines of FIGS. 1-4.

FIG. 8 next illustrates another example user interface 300 including example fabric and cycle modifier slider controls 302 and 304 (designated as "fabric" and "clean power" slider controls), and suitable for implementation on a touchscreen display. In some embodiments, the touchscreen display may be implemented on the housing or cabinet of a laundry treatment appliance such that the processor that drives the display and generates the combination of settings for use in performing a laundry treatment cycle may, in some instances, also perform the laundry treatment cycle. In other embodiments, however, the processor that drives the display and generates the combination of settings for use in performing the laundry treatment cycle may be separate from the processor or controller that actually controls the laundry treatment appliance to perform the laundry treatment cycle. For example, the user interface and the processor(s) that drive the user interface may be in an external device such as a mobile phone, computer or tablet, whereby the selected combination of setting values may be communicated to the appliance's on-board controller to enable the controller to perform of the laundry treatment cycle using the selected combination of setting values.

In this embodiment, the slider controls 302, 304 are vertically oriented rather than horizontally oriented, as is the case with user interfaces 100, 200 and 280. In addition, two additional slider controls, a spin speed slider control 306 and a temperature slider control 308, are also provided in user interface 300. User interface 300 also utilizes labels adjacent to each slider control 302-308 to represent the relative positions of various selections, and bars that grow from the bottom of each slider control are used to represent the current selection for each slider control. In addition, as represented by slider control 308, it may also be desirable to change a display characteristic (e.g., color, pattern, animation, etc.) of a slider control based upon a current selection. For slider control 308, which selects from among different temperature settings, it may be desirable to change the color of the slider control from blue to red to represent different temperature settings.

In some embodiments, additional slider controls such as slider controls 306, 308 may be used to configure different settings than fabric and cycle modifier slider controls. In other embodiments, however, the additional slider controls may be used in connection with fabric and/or cycle modifier slider controls to configure settings for a laundry treatment cycle.

Figure 9:
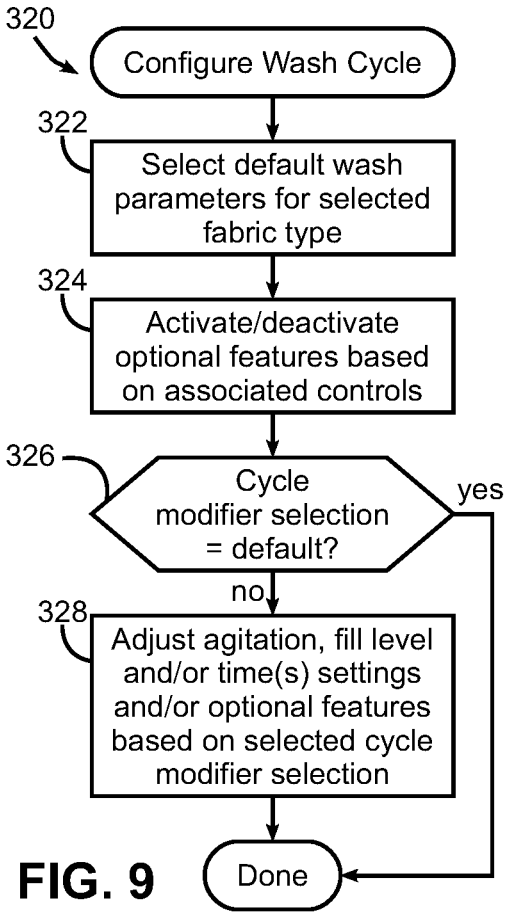
FIG. 9 is a flowchart illustrating an example sequence of operations for configuring a wash cycle in the laundry washing machines of FIGS. 1-4.

Now turning to FIG. 9, this figure illustrates an example sequence of operations 320 performed by one or more processors (e.g., a processor in controller 70 or an external device 86) to configure a laundry treatment cycle, e.g., a wash cycle in a laundry washing machine. For user interface 100 of FIG. 5, as one example, the sequence may be executed in response to a user selecting start button 108, or alternatively, any time a control in user interface 100 is modified by a user. The sequence starts in block 322 by initially selecting a default combination of setting values for the fabric type represented by the currently selected fabric selection. Block 324 then activates and/or deactivates various optional features based on the current states of the associated controls (e.g., button controls 110-114). Block 326 next determines if the current cycle modifier selection is the default selection. If so, no modification of the default combination of setting values is needed, and the sequence is complete. Otherwise, control first passes to block 328 to adjust agitation, fill level and/or various time setting values and/or optional feature setting values in the selected combination of setting values based upon the selected cycle modifier selection. In some embodiments, a display may also be updated in sequence 320 to reflect the current combination of setting values and thereby enable a user to view the effect of the current user interface control states on the laundry treatment cycle.

Figure 10:
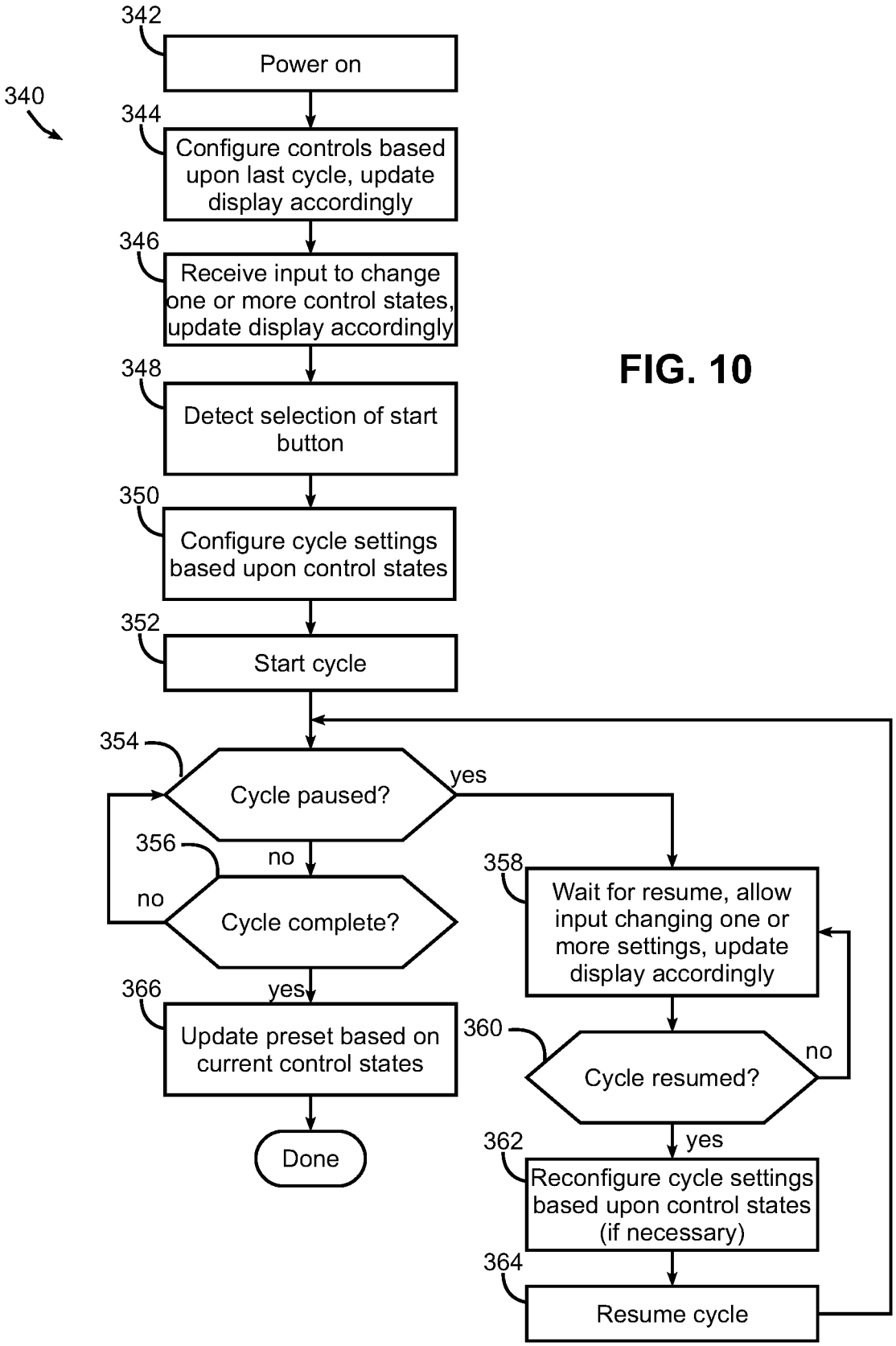
FIG. 10 is a flowchart illustrating an example sequence of operations for performing a wash cycle in the laundry washing machines of FIGS. 1-4.

FIG. 10 illustrates a sequence of operations 340 for performing a laundry treatment cycle, e.g., a wash cycle, e.g., as may be performed by a processor in controller 70, either with or without assistance from an external device. For user interface 200 of FIG. 5, as one example, the sequence may be executed in response to a user selecting power button 206, which results in power on of the appliance as illustrated in block 342. Upon power up, block 344 may configure the user interface controls based upon the last laundry treatment cycle, e.g., to activate the associated indicators 220-256 on slider controls 202, 204 and 218 corresponding to the previously selected fabric, cycle modifier and preset selections, as well as to activate any of optional feature buttons 210-212.

Next, block 346 optionally receives user input to user interface 200 that changes one or more control states (e.g., in response to input directed to any of slider controls 202, 204, 218 and/or optional feature buttons 210-212), and updates the display accordingly. Then, upon detection of user selection of start button 208 in block 348, control passes to block 350 to configure the settings for the laundry treatment cycle based upon the current control states of user interface 200, e.g., using sequence of operations 320 of FIG.

9. Block 352 then starts the cycle, and decision blocks 354 and 356 are periodically tested during the progress of the cycle.

Block 354, for example, determines whether the cycle has been paused, e.g., in response to user selection of button 208. If so, control passes to block 358 to wait for the user to request resumption of the cycle, e.g., by selecting button 208. While waiting for the request, a user may also vary one or more controls in user interface 200, which in turn may update various setting values, e.g., using sequence 320 of FIG. 9. It will be appreciated that in some instances, some setting values may no longer be pertinent to the remaining operations performed in the cycle, so no updates to those setting values may be performed. As one example, a user may determine during a cycle that the user needs the cycle to complete more quickly, and may adjust cycle modifier slider control 204 to select a cycle decrease selection to shorten the remaining phases of the cycle.

Block 360 determines whether the user has requested for the cycle to be resumed, and if not, returns control to block 358. Once resumption of the cycle has been requested, however, control passes to block 362 to reconfigure the cycle settings based upon the new control states (if necessary), and then to block 364 to resume the cycle. Control then returns to block 354 to continue the cycle.

Block 356 determines whether the cycle has completed. If not, control returns to block 354 and the cycle continues through the various phases of the cycle, and with the current setting values used to control the operation of the cycle. Once the cycle has completed, however, control optionally passes to block 366 to update the currently-selected preset selection based upon the current control states, and the sequence is complete. Thus, for example, in user interface 200 depicted in FIG. 6, block 366 may update the "A" preset selection represented by indicator 246 with the default selection represented by indicator 238 of cycle modifier slider control 204 and the cotton fabric selection represented by indicator 220 of fabric slider control 202, such that the next time the "A" preset selection is selected by a user, the default selection and cotton fabric selection will be automatically selected in the user interface.

Figure 11:
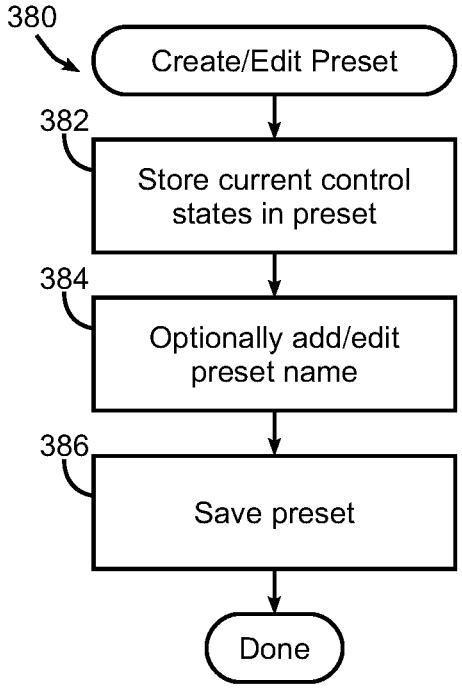
FIG. 11 is a flowchart illustrating an example sequence of operations for creating or editing a preset in the laundry washing machines of FIGS. 1-4.

The use of presets is optional in some embodiments. Where presets are used, a sequence of operations such as sequence 380 of FIG. 11 may be used to create and/or edit presets. Sequence 380 may be initiated, for example, in response to a long press of the indicator associated with the preset, via a menu option on a touchscreen display, or in other manners that will be apparent to those of ordinary skill in the art. Sequence 380 may begin in block 382 by storing the current control states in the user interface in the preset, and block 384 may optionally add or edit a name for the preset (e.g., using a touchscreen keyboard or in other appropriate manners). In some embodiments, the preset slider control may include a reconfigurable display such that the preset names may be displayed in lieu of the "A"-"G" indicators illustrated in FIG. 6. Next, block 386 saves the present, and sequence 380 is complete.

While various settings may be configured using the herein-described techniques, in one example embodiment, a fabric slider control and cycle modifier slider control may be used to vary an agitation duty cycle, a water fill level, a wash time, a first rinse time, a second rinse time, and a spin time. Each fabric selection may be associated with a default combination of values for these settings, and the cycle modifier slider control may have a default selection as well as +/−10, 20 and 30% selections. The +/−10, 20 and 30% selections may vary the default agitation duty cycle for each fabric selection by +/−10, 20 and 30% respectively, vary the default water fill level for each fabric selection by +/−5 or 10% respectively (e.g., the fill levels for the +/−20% selections are the same as those for the +/−30% selections), vary the default wash, first rinse and second rinse times for each fabric selection by +/−10 or 20% respectively (e.g., the times for the +/−20% selections are the same as those for the +/−30% selections), and vary the default spin time for each fabric selection by +/−10, 20 and 30% respectively. The above modifications will be appreciated to be merely examples, however, so the invention is not limited to these particular modifications.

Various additional modifications may be made to the illustrated embodiments consistent with the invention. Therefore, the invention lies in the claims hereinafter appended.

What is claimed is:

1. A laundry treatment appliance, comprising:

a container rotatably disposed within a housing;

a drive system configured to rotate the container;

a controller coupled to the drive system and configured to perform a laundry treatment cycle on a load disposed in the container; and a processor in communication with a user interface through which user input is received to configure a plurality of settings for the laundry treatment cycle performed by the controller;

wherein the user interface includes:

a fabric slider control configured to receive user input that selects from among a plurality of fabric selections, wherein each of the plurality of fabric selections is associated with a default combination of setting values for the plurality of settings; and a cycle modifier slider control configured to receive user input that selects from among a plurality of cycle modifier selections, the plurality of cycle modifier selections including one or more cycle increase selections and one or more cycle decrease selections defined across a range of positions for the cycle modifier slider control, at least a subset of the plurality of cycle modifier selections configured to modify setting values for multiple settings among the plurality of settings; and wherein the processor is configured to, in response to selection of a first fabric selection from among the plurality of fabric selections and a first cycle modifier selection from among the plurality of cycle modifier selections, select a combination of setting values for the plurality of settings for use in performing the laundry treatment cycle, the selected combination of setting values including multiple setting values that are modified relative to the default combination of setting values associated with the first fabric selection based upon selection of the first cycle modifier selection;

wherein the plurality of settings includes an agitation duty cycle, a water fill level, a wash time, a first rinse time, a second rinse time, and a spin time;

wherein the one or more cycle increase selections are each identified in the user interface by a positive percentage value, and each of the one or more cycle decrease selections are each identified in the user interface by a negative percentage value; and wherein the processor is configured to, for at least two settings among the agitation duty cycle, the water fill level, the wash time, the first rinse time, the second rinse time, and the spin time, modify setting values in the default combination of setting values associated with the first fabric selection by a percentage that corresponds to a percentage value identified in the user interface for the first cycle modifier selection.

2. The laundry treatment appliance of claim 1, wherein the default combination of setting values for the plurality of settings for each of the plurality of fabric selections is optimized for treating an associated fabric.

3. The laundry treatment appliance of claim 2, wherein each of the one or more cycle increase selections and each of the one or more cycle decrease selections is associated with, for each of the plurality of fabric selections, a modified combination of setting values that differs from the default combination of setting values.

4. The laundry treatment appliance of claim 3, wherein the plurality of cycle modifier selections further includes a default selection, and wherein the processor is configured to, when the first cycle modifier selection is the default selection, use the default combination of setting values for the first fabric selection as the selected combination of setting values to use when performing the laundry treatment cycle.

5. The laundry treatment appliance of claim 4, wherein the processor is configured to, when the first cycle modifier selection is one of the one or more cycle increase selections, use a modified combination of setting values as the selected combination of setting values to use when performing the laundry treatment cycle, and wherein the modified combination of setting values includes at least one setting value that is increased relative to a corresponding setting value in the default combination of setting values for the first fabric selection.

6. The laundry treatment appliance of claim 5, wherein the modified combination of setting values includes a plurality of setting values that are increased relative to corresponding setting values in the default combination of setting values for the first fabric selection.

7. The laundry treatment appliance of claim 4, wherein the processor is configured to, when the first cycle modifier selection is one of the one or more cycle decrease selections, use a modified combination of setting values as the selected combination of setting values to use when performing the laundry treatment cycle, and wherein the modified combination of setting values includes at least one setting value that is decreased relative to a corresponding setting value in the default combination of setting values for the first fabric selection.

8. The laundry treatment appliance of claim 7, wherein the modified combination of setting values includes a plurality of setting values that are decreased relative to corresponding setting values in the default combination of setting values for the first fabric selection.

9. The laundry treatment appliance of claim 4, wherein each of the one or more cycle increase selections and each of the one or more cycle decrease selections is associated with a modifier value that, when the associated cycle increase selection or cycle decrease selection is the first cycle modifier selection, scales one or more setting values in the default combination of setting values for the first fabric selection.

10. The laundry treatment appliance of claim 1, wherein the processor is configured to select the combination of setting values for the plurality of settings for use in performing the laundry treatment cycle by accessing a table of setting combinations indexed by fabric selection and cycle modifier selection.

11. The laundry treatment appliance of claim 1, wherein the laundry treatment appliance is a washing machine, and wherein the plurality of settings further include one or more of an agitation setting, a wash repeat setting, a rinse repeat setting, a spin repeat setting, a spin speed setting, a steam setting, a sanitize setting, a temperature setting, and/or a soak time setting.

12. The laundry treatment appliance of claim 1, wherein the processor is disposed in the controller, wherein the user interface is disposed on the housing, and wherein the processor further performs the laundry treatment cycle on the load disposed in the container.

13. The laundry treatment appliance of claim 1, wherein the processor is disposed in an external device in communication with the controller, wherein the user interface is disposed on the external device, and wherein the processor is further configured to communicate the selected combination of setting values to the controller.

14. The laundry treatment appliance of claim 13, wherein the external device is a mobile phone or tablet.

15. The laundry treatment appliance of claim 1, wherein the user interface comprises a touchscreen display.

16. The laundry treatment appliance of claim 1, wherein each of the fabric slider control and the cycle modifier slider control includes a touch-sensitive strip.

17. The laundry treatment appliance of claim 1, wherein each of the fabric slider control and the cycle modifier slider control includes a mechanical slider.

18. The laundry treatment appliance of claim 17, wherein the mechanical slider for each of the fabric slider control and the cycle modifier slider control is motorized.

19. The laundry treatment appliance of claim 1, wherein each of the fabric slider control and the cycle modifier slider control includes up and down buttons.

20. The laundry treatment appliance of claim 1, wherein each of the fabric slider control and the cycle modifier slider control is a rotary control.

21. The laundry treatment appliance of claim 1, wherein the user interface further includes a plurality of optional feature buttons, and wherein the processor is further configured to activate an optional feature during the laundry treatment cycle in response to selection of an associated optional feature button from among the plurality of optional feature buttons.

22. The laundry treatment appliance of claim 1, wherein the user interface further includes a preset slider control configured to receive user input that selects from among a plurality of preset selections, wherein each of the plurality of preset selections includes an associated fabric selection from among the plurality of fabric selections and an associated cycle modifier selection from among the plurality of cycle modifier selections, and wherein the processor is configured to, in response to selection of a first preset selection from among the plurality of preset selections, select the associated fabric selection for the first preset selection on the fabric slider control and select the associated cycle modifier selection for the first present selection on the cycle modifier slider control.

23. The laundry treatment appliance of claim 22, wherein the processor is further configured to, in connection with performing the laundry treatment cycle, update the first preset selection based upon current selections of each of the fabric slider control and cycle modifier slider control.

24. The laundry treatment appliance of claim 1, wherein the user interface further includes a spin speed slider control configured to receive user input that selects from among a plurality of spin speed selections and a temperature slider control configured to receive user input that selects from among a plurality of temperature selections, and wherein the processor is configured to set spin speed and temperature settings for use in performing the laundry treatment cycle based upon user input directed to the spin speed slider control and temperature slider control.

25. The laundry treatment appliance of claim 1, wherein the processor is configured to pause the laundry treatment cycle in response to user input directed to the user interface, to modify the selected combination of setting values for the plurality of settings in response to user input directed to the fabric slider control and/or the cycle modifier slider control while the laundry treatment cycle is paused, and to restart the laundry treatment cycle using the modified combination of setting values in response to user input directed to the user interface.

26. The laundry treatment appliance of claim 1, wherein the user interface further comprises a spin speed slider control configured to receive user input that adjusts a spin speed and a temperature slider control configured to receive user input that adjusts a water temperature.

27. The laundry treatment appliance of claim 26, wherein each of the cycle modifier control, the spin speed slider control and the temperature slider controls are continuous controls.

* * * * *